United States Patent [19]

Arnold

[11] 4,142,254

[45] Mar. 6, 1979

[54] FULLY VENTILATED STORM SUIT

[76] Inventor: Forest D. Arnold, 7315 Allan Ave., Falls Church, Va. 22046

[21] Appl. No.: 728,617

[22] Filed: Oct. 1, 1976

[51] Int. Cl.[2] ..... A41D 9/00

[52] U.S. Cl. ..... 2/84

[58] Field of Search ..... 2/84, 85, 86, 87, 88

[56] References Cited

U.S. PATENT DOCUMENTS

| | | | |
|---|---|---|---|
| 1,374,301 | 12/1921 | Howard | 2/88 |
| 2,372,110 | 3/1945 | Noone | 2/84 |

FOREIGN PATENT DOCUMENTS

| | | | |
|---|---|---|---|
| 4380 of | 1901 | United Kingdom | 2/86 |

*Primary Examiner*—Werner H. Schroeder
*Assistant Examiner*—Doris L. Troutman

[57] ABSTRACT

This invention comprises a storm suit of four components to be used in combination:

(a) a one piece cape and hood with a front opening with the upper section of the front opening being secured around the face by means of a drawstring and with temporary fasteners to attach the cape and hood to the sleeves and body of the garment, (b) a sleeve arrangement comprised of waterproof material for that part of the arms not protected by the cape and hood and an arrangement of non waterproof material that is cut away over the armpits and extends over the shoulders and with a means for fastening and detaching the component around the neck and upper arms so that the sleeve arrangement can be removed or left hanging, (c) a body covering held up by suspenders for that part of the body not protected by the cape and hood extending downwards and flaring outwards from the top below the chest to the bottom at the upper leg to be used with other means of protection for the lower body such as rain chaps or rain pants, (d) a closure system comprised of temporary fasteners for attaching together the free edges of the cape and hood and the body covering which provides for variations in ventilation and protection.

7 Claims, 5 Drawing Figures

FIG.1
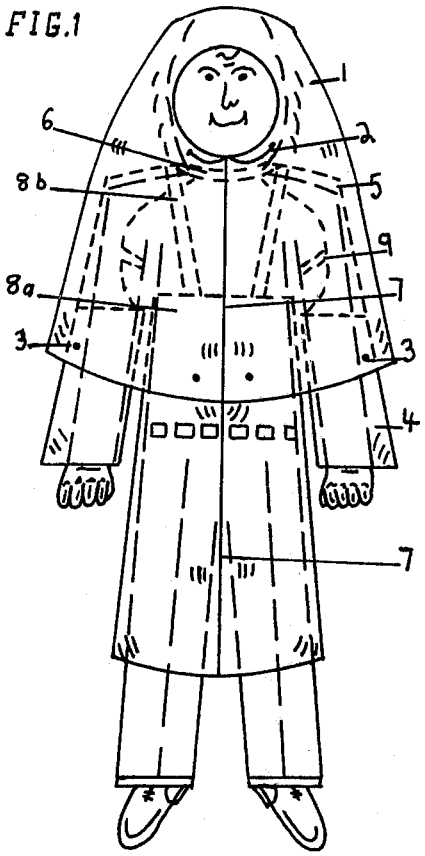
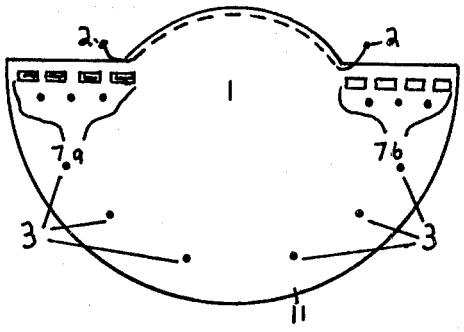
FIG.2
FIG.3
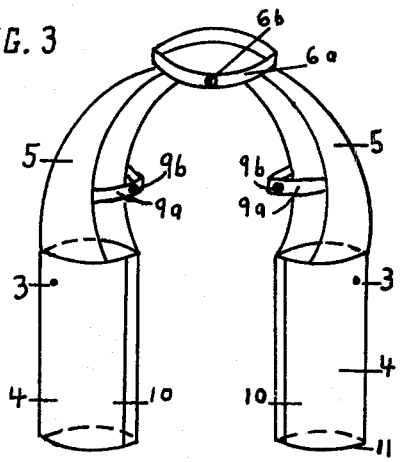
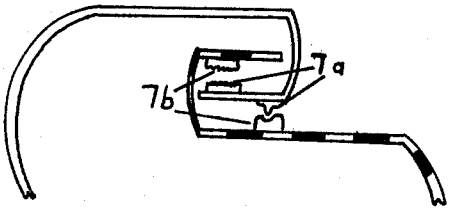
FIG.5
FIG.4
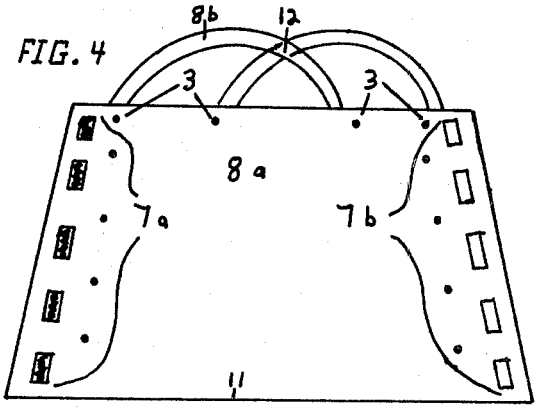

FULLY VENTILATED STORM SUIT

This invention relates to storm suits and especially to storm suits to be worn over waterproof coverings for the trousers or legs such as rain chaps or rain pants.

It has been well documented that the body loses heat much faster when it is wet than when it is dry. In addition to the discomfort that is caused from the loss of heat there is the danger of hypothermia occuring which can lead to death in extreme cases. Hypothermia occurs most frequently between thirty and fifty degrees Farenheit. The conditions of cold rain or wet snow and sleet occur in this temperature range and are the conditions when rain garments would be used and would need to be the most effective. Heretofore rain clothing allowed the wearer to get wet and lose heat from either condensed perspiration during exertion which is due to the lack of ventilation or from seams that are not fully waterproof due to construction or wear on the garment. Any seam is a potential source of leakage so, ideally a garment is desired that allows the air to cool the upper torso, arms and armpits and the lower torso and crotch. These areas are generally the greatest source of perspiration. Since conditions of exertion and rainfall vary, a garment is also needed that allows for different degrees of protection and ventilation. The garment should be so designed that adjustments can be quickly and easily made without having to stop to put on or put away any component.

It thus is a general object of this invention to provide a storm suit of simple design to protect the wearer from rain and provide full ventilation and adjustability so that the garment does not cause condensation and subsequent wetness and loss of heat during exertion.

Another object of the invention is to provide a storm suit that has no seams accessible to the entrance of rain. This will provide a garment that may be easily folded into a compact bundle for carrying and can be simply and cheaply manufactured.

A further object is to provide a storm suit which affords different degrees of protection and ventilation for respective regions of the body but which remains accessible to that region when not immediately in use.

Another object is to provide closures for the different components which allow varying degrees of ventilation and still provide a fully waterproof covering.

A further object is to provide a storm suit with separate components which can provide different degrees of adjustability but can be secured in case of wind or for use with a backpack.

With these objects in view the present invention relates to a three piece garment comprised of a seamless cape and hood with a drawstring to secure it around the face and temporary fasteners to secure it to the arms and body of the garment; a sleeve arrangement that provides a waterproof covering for that part of the arms not protected by the cape and a non waterproof cloth arrangement that goes over the shoulders, is cut away over the armpits and attached to the neck so that the sleeves can be removed and left hanging and accessible when the arms get overheated and a body covering that is held by suspenders which allows full ventilation of the upper chest and armpits but is long enough to sit upon and still provide freedom of movement and ventilation to the crotch and lower torso; and a closure system comprised of temporary fasteners for attaching together the free edges of the cape and hood and the body covering.

The construction and operation of the invention as well as additional objects and advantages thereof will be best understood from the ensuing description which relates to the accompanying drawings in which FIG. 1 is a front view of the garment of the present invention.

FIG. 2 is a front view of the cape 1 as it would be laid out for a pattern and cutting.

FIG. 3 shows the sleeve arrangement (4,5,6,9 in FIG. 1).

FIG. 4 shows the body and strap arrangement (**8*a*, 8*b* in FIG. 1**).

FIG. 5 shows in detail a horizontal section of the closure arrangement located at points 7 on the cape 1 and body **8*a* in FIG. 1 and in detail as 7*a*,7*b* in FIGS. 2,4,5**.

Referring now to the drawings and in particular FIG. 1, it will be seen that the garment of the present invention comprises a cape and hood arrangement 1 which is secured around the face by a drawstring 2 and secured to the sleeves and body of the garment by temporary fasteners 3. The cape is attached to itself for closure and ventilation by two layers of temporary fasteners 7 (see FIG. 5 for detail). It should be noted that the hood part of cape 1 can be lowered and secured around the neck by means of the drawstring 2 when full protection for the head is not needed. The pyramidal shape of the cape and hood allows for the flow of air around the neck and shoulders. The cape 1 overlaps the body of the garment **8*a* which provides protection from rain but ventilation for the upper chest and armpits. The body component 8*a* is hung from the shoulders by means of straps 8*b* and is attached to itself for closure and ventilation by means of closure system 7 (see FIG. 5 for detail). The cape 1 also overlaps the sleeve arrangement of the garment 4,5,6,9 to provide protection from rain for the lower arm by means of a sleeve made of waterproof cloth 4 and ventilation for the upper arms and armpits by means of a sleeve arrangement made of non waterproof cloth 5. The upper sleeve 5 is attached to the arm to prevent slippage by a strap with a snap or other suitable attachment 9. The entire sleeve arrangement 4,5,9 is held around the neck by means of a collarpiece with a snap attachement 6. It should be noted that this allows the arms to be slipped out of the sleeves in case of overheating without directly removing the component or exposing it to the rain. The cape is cut full enough to overlap the sleeves and body sufficiently to allow the arms to be folded across the chest and still provide rain protection when wearing the sleeves is not desired. Snaps 3** are provided on the body and sleeve components to secure the cape in case of wind. It should be further noted that the body component can be rolled up on itself and still be left hanging on the wearer in case of overheating or when the wearer wishes to only wear the cape but not have to remove the body component. Further if the wearer is carrying a backpack the pack straps can be protected by being worn under the cape and by tucking the cape around the back and shoulders of the wearer next to the pack. This provides greater ventilation for the upper back but can provide an entrance for rain in heavy storm weather in which case it would be advisable to wear the cape under the straps of the backpack. It should be noted that this adjustability of separate components makes it possible to modify the garment to fit the demands of different usages. Heretofore this has not been possible with one piece garments.

The pattern from which the cape 1 is to be cut is best shown in FIG. 2. It should be noted that by preparing the cape 1 from one piece of cloth that all seams except edge seams are eliminated. The edge seam 11 would be a standard turned under seam and does not form part of the present invention and therefore does not appear in detail in the drawing. It should be noted that the loosely formed shape of the hood around the neck and shoulders provides for better hearing than the normal tailored hood in addition to providing better ventilation for the neck and shoulders. The hood is attached around the face by means of a drawstring 2. The two edges of the cape 1 are attached to each other respectively by means of a closure system 7*a* and 7*b* (7*b* is not facing you in the view) (see FIG. 5 for detail). They should be parallel and arranged centrally on the body at an angle perpendicular to the ground plane. The cape 1 is attached to the body component 8*a* (see FIG. 1) and the sleeve 4 by means of snaps or some other suitable temporary fasteners 3.

The pattern from which the sleeve component (4,5,6,9 in FIG. 1) is to be cut is best described in FIG. 3. The lower sleeve 4 is to be made of waterproof material and is attached to itself by means of a seam 10 and finished at the bottom by means of a seam 11. The seams 10 and 11 would be standard seams and their construction does not form part of the present invention and therefore does not appear in detail in the drawing. The placement of seam 10 is pertinent to the invention however, for it is to be on the inside of the arm parallel to the body so as to afford the greatest protection from direct exposure to rain. The upper sleeve attachment 5 is to be made of non waterproof cloth so as to avoid condensation due to body contact. It is cut away from the underarms for ventilation but is attached to the upper arm to prevent slippage by means of a strap 9*a* with a snap or other suitable form of temporary fastener 9*a*. The upper sleeve 5 is to be attached around the neck by means of a collar made of non waterproof cloth 6*a* and attached to itself by means of a snap or other suitable attachment 6*b*. It should be noted that the collar arrangement 6*a*, 6*b* allows the component to be easily and readily put on or removed without removing or altering any other component of the garment. The sleeve 4 is attached to the cape by means of snaps or other suitable attachment 3 (see FIG. 2 for accompanying placement).

The pattern from which the body component 8*a* is to be cut is best shown in FIG. 4. It is to be finished by means of seam 11 which is to be of standard construction and does not form part of the present invention and so is not shown in detail in the drawing. The body piece 8*a* is to be hung over the shoulders by means of straps 8*b*.

The straps are to be crossed and reinforced 12 but the configuration of the straps should not be confused with their overall purpose which is to allow the upper chest full ventilation and allow the component to be accessible even when rolled up under the cape. The body 8*a* is to be attached to the cape by means of snaps or other suitable temporary fasteners 3 (see FIG. 2 for accompanying attachment placement). The two edges of the body 8*a* are attached to each other respectively by means of a closure system 7*a* and 7*b* (not facing in the view) (see FIG. 5 for detail) and should be parallel and arranged centrally on the body at an angle perpendicular to the ground plane.

The means of attaching the respective edges 7*a* and 7*b* of the cape 1 in FIG. 2 and the respective edges 7*a* and 7*b* of the body 8*a* in FIG. 4 is best shown and understood in FIG. 5. 7*a* consists of a piece of hook and eye cloth (trade name Velcro) on the inside of the component 1 or 8*a* and a snap or other suitable attachment on the outside of the component 1 or 8*a* which is to be rolled over to be attached to the corresponding attachment 7*b* on the outside of the component 1 or 8*a* and corresponding hook and eye cloth 7*b* on the outside of the garment. The configuration of the attachment system should not be confused with it's overall purpose which is to provide different levels of ventilation and protection depending on how they are employed.

The cape 1, sleeve 4 and body 8*a* should be formed of coated nylon, plastic, rubberized fabric or any other waterproof fabric. The upper sleeve 5, the neck piece 6, the strap 9 and the straps 8*a* should be formed of any lightweight breathable cloth that will not greatly absorb moisture or provide too much elasticity.

It should be understood that each of the element components of the garment described above or two or more elements together may also find a useful application in conjunction with other types of waterproof garments differing from the types described above.

Adaptations that constitute essential characteristics of this invention are intended to fall within the range of meaning of the following claims and I claim:

1. A fully ventilated storm suit of waterproof material comprised of four components to be used in combination:

(a) a cape with a face opening overlapping a lower body covering and sleeves, adapted to cover the head, shoulders, upper trunk and upper arms of the wearer, (b) a sleeve arrangement having a lower portion of waterproof material constructed with an inward seam covering that part of the arms not covered by the cape and hood and attached to an upper portion made of non waterproof material suspended from an attachment at the neck providing a detachable sleeve that may be left hanging from the wearers neck when not needed for lower arm protection, (c) a waterproof covering suspended from the shoulders of the wearer adapted to cover the lower trunk, body and upper legs of the wearer, (d) a closure system comprised of temporary fasteners for attaching together the free edges of said cape and hood and said body covering.

2. A fully ventilated storm suit of waterproof material as recited in claim 1 wherein said cape is comprised of a one piece cape and hood having a front opening with an opening for the face, having a drawstring to secure said front opening around the face.

3. A fully ventilated storm suit of waterproof material as recited in claim 1 wherein said cape is comprised of a substantially pyramidal shape to provide for the passage of air around the neck and shoulders.

4. A fully ventilated storm suit of waterproof material as recited in claim 1 wherein said sleeve arrangement has a tubular shaped lower portion of waterproof material covering that part of the arms not covered by the cape and constructed with a seam to be located on the inside of the arm extending upwards lengthwise and having an upper portion of non waterproof material cut so as to leave the armpit exposed and extending over the shoulders and provided with strips of material with temporary fasteners for attaching and detaching said upper portion around the neck and upper arms to allow said component to be readily secured to the body or easily removed and left hanging.

5. A fully ventilated storm suit of waterproof material as recited in claim 1 wherein said lower body covering is comprised of a one piece body covering for that part of the body not covered by the cape and hood and having a front opening and having suspenders constructed of waterproof or non waterproof material as desired and crossed so as to be interlocking to hold said body covering in a position extending downwards from the chest and flaring outwards to the bottom at the upper leg being disposed therein to provide waterproof material to sit upon and being free for relative movement.

6. A fully ventilated storm suit of waterproof materal as recited in claim 1 wherein said cape is to be securable to said body covering and said sleeve arrangement by temporary fasteners where it overlaps the sleeves and body of the garment.

7. A fully ventilated storm suit of waterproof material as recited in claim 1 wherein said closure system is comprised of continuous or periodically spaced temporary fasteners for attaching the overlapped edge portions of said cape and hood and said body covering with a temporary fastener of the inward surface of said first edge portion of the outer edge being attached to a temporary fastener on the outward surface of said second edge portion of the inner edge and then folded laterally inwards and attached by a second temporary fastener located on the outer surface of said outer edge to a second temporary fastener located on the outer surface of said inner edge, said first and second temporary fasteners being adjacent on opposite surfaces and spaced to accomplish smaller or greater degree of overlap as desired.

* * * * *